United States Patent [19]

Kemp

[11] 4,318,437

[45] Mar. 9, 1982

[54] METAL CASTING SYSTEM

[76] Inventor: Willard E. Kemp, 1035 Dairy Ashford Rd., Suite 146, Houston, Tex. 77079

[21] Appl. No.: 182,429

[22] Filed: Aug. 29, 1980

[51] Int. Cl.[3] ..... B22C 15/22

[52] U.S. Cl. ..... 164/7.2; 164/34; 164/99; 164/160.2; 164/122

[58] Field of Search ..... 164/7, 34, 160, 122, 164/98, 99, 123

[56] References Cited

U.S. PATENT DOCUMENTS

| | | | |
|---|---|---|---|
| 3,460,605 | 8/1969 | Beetle et al. | 164/123 |
| 3,789,907 | 2/1974 | Nakata et al. | 164/7 |
| 3,825,058 | 7/1974 | Miura et al. | 164/253 |
| 3,832,117 | 8/1974 | Hijikata et al. | 425/388 |
| 3,843,301 | 10/1974 | Hijikata et al. | 425/388 |
| 3,861,447 | 1/1975 | Hondo | 164/34 |
| 3,887,321 | 6/1975 | Hijikata et al. | 425/388 |
| 3,952,793 | 4/1976 | Hijikata et al. | 164/7.2 X |
| 3,955,266 | 5/1976 | Honami et al. | 164/7.2 X |
| 3,993,194 | 11/1976 | Reuland | 209/81 R |
| 4,009,747 | 3/1977 | Miura et al. | 164/7.2 |
| 4,167,206 | 9/1979 | Terada et al. | 164/7.2 |

FOREIGN PATENT DOCUMENTS

| | | | |
|---|---|---|---|
| 51-23369 | 7/1976 | Japan | 164/7 |
| 55-12173 | 3/1980 | Japan | 164/98 |

*Primary Examiner*—Robert D. Baldwin
*Assistant Examiner*—K. Y. Lin
*Attorney, Agent, or Firm*—Vaden, Eickenroht, Thompson, Bednar & Jamison

[57] ABSTRACT

A metal casting system including novel process and apparatus wherein the shape of the casting is defined by a thin thermal degrading film supported by a particulate bed. A pattern having the shape of the desired casting is surrounded by the tight fitting film with one end of the pattern exposed. A particulate bed is tightly packed about the film-surrounded pattern. A reduced fluid pressure is established within the particulate bed relative to the pattern so that the surrounding film is tightly held by atmospheric pressure against the particulate bed and slightly released from the pattern. The pattern is removed from the surrounding film and leaves therein a cavity bounded by the film with the shape of the desired casting. The cavity is filled with molten metal for forming the desired casting simultaneously with the vaporization of the film. The present metal casting system is especially useful for the casting of cylindrical shapes using unique molds and a novel flask is provided for such a casting process.

40 Claims, 14 Drawing Figures

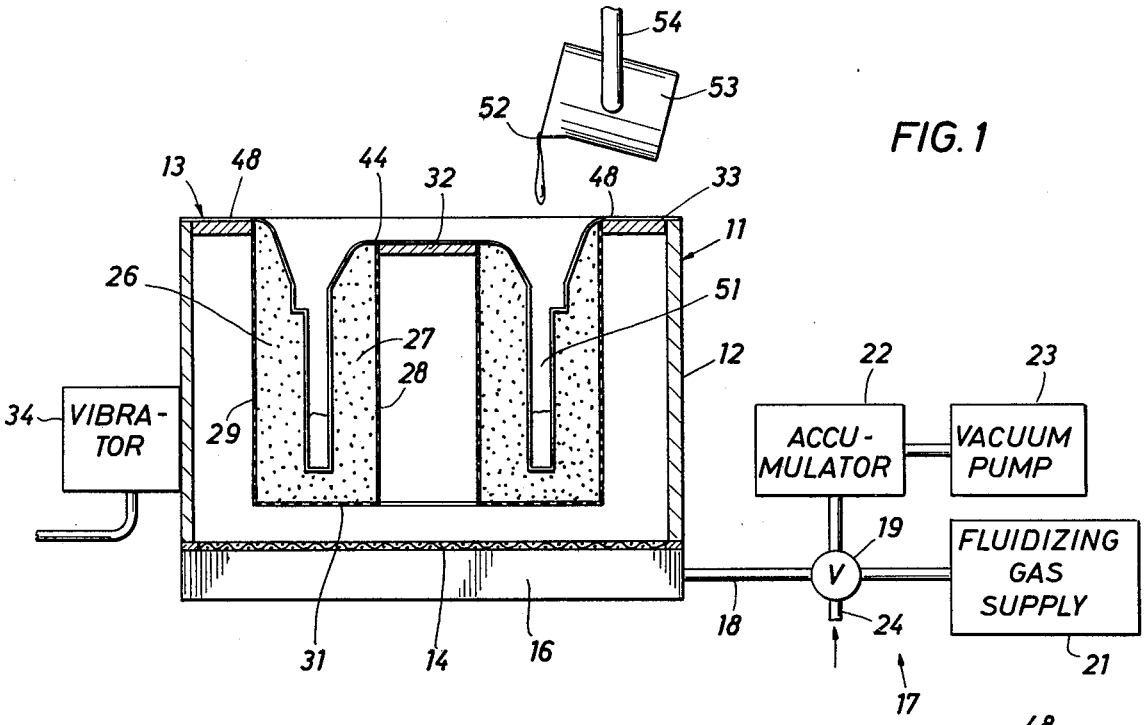
FIG. 1
FIG. 2
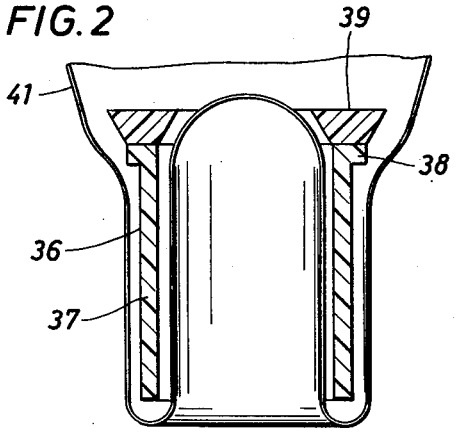
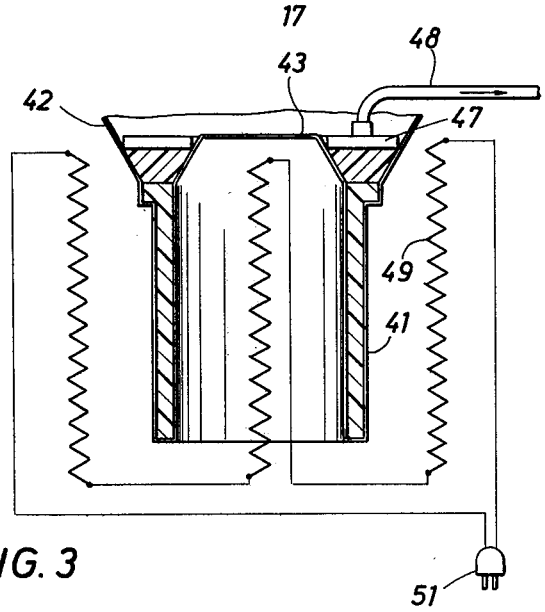
FIG. 3
FIG. 5
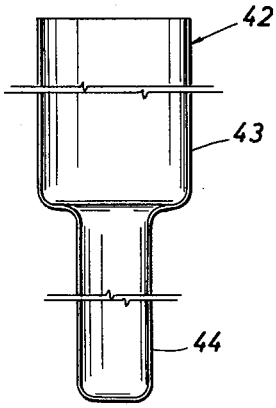
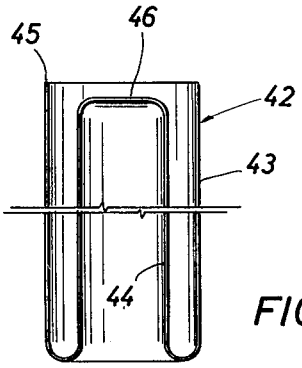
FIG. 6

FIG. 4
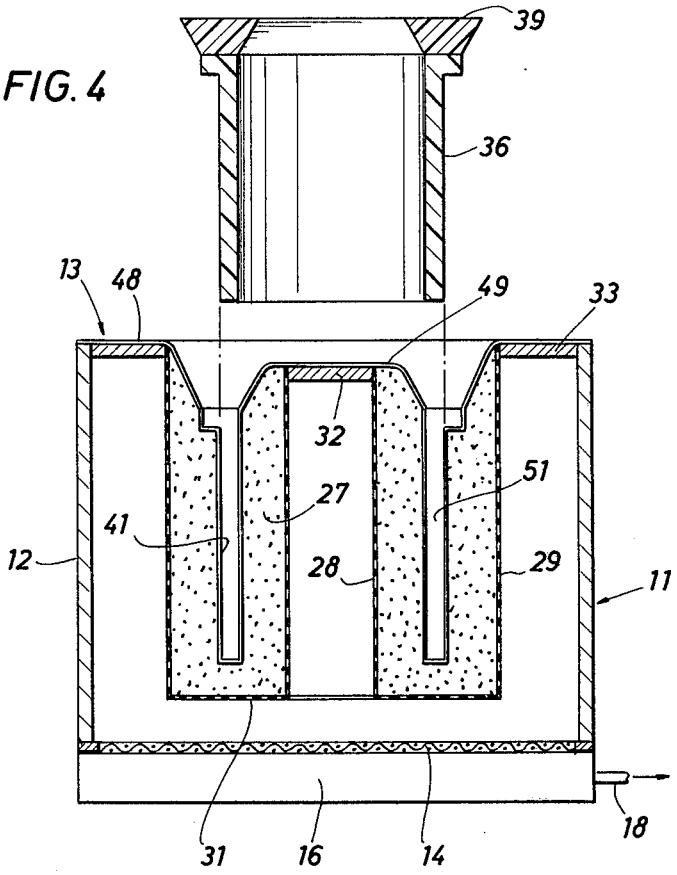
FIG. 7
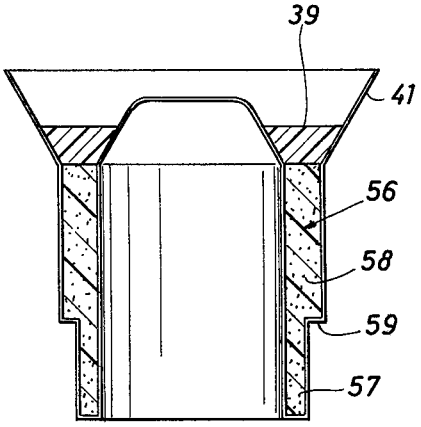
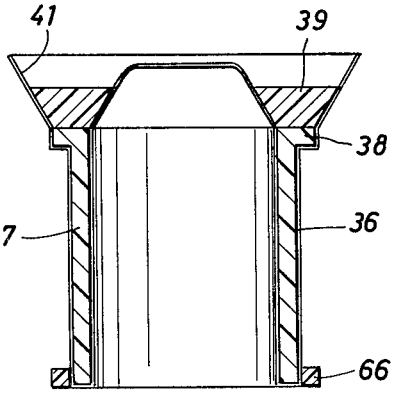
FIG. 9
FIG. 8
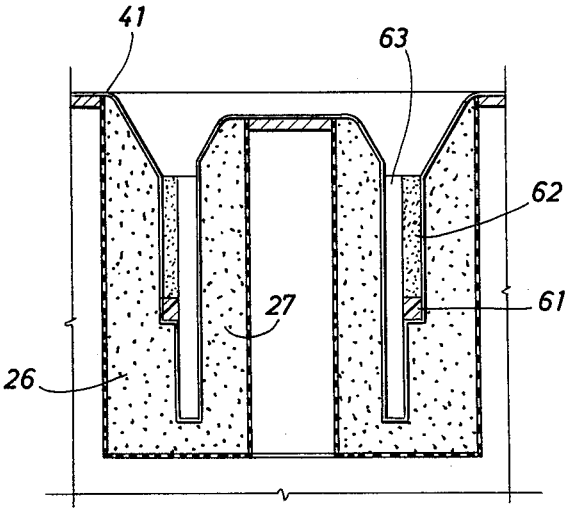
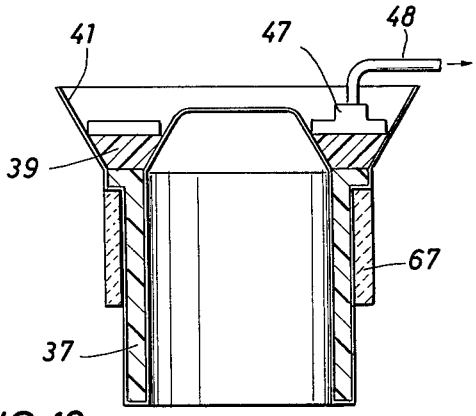
FIG. 10

FIG. 11
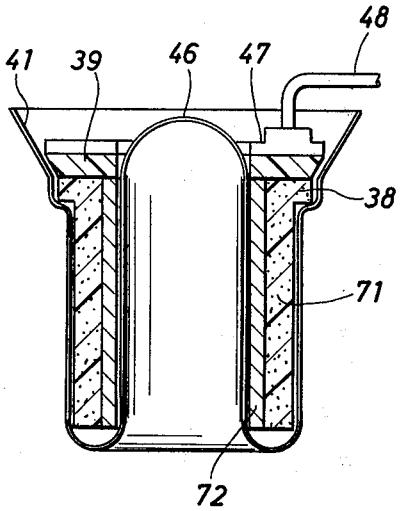
FIG. 12
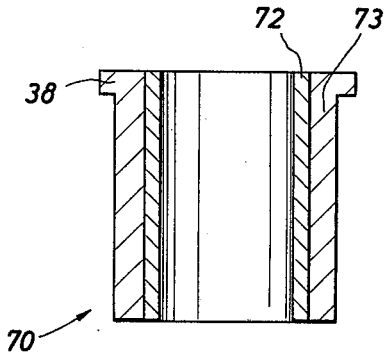
FIG. 13
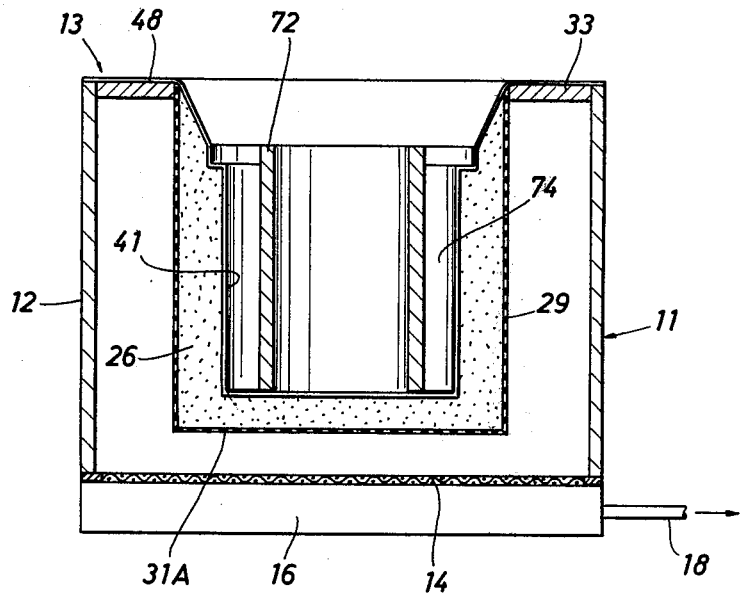
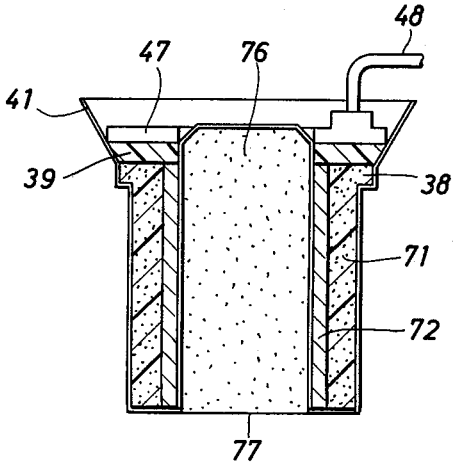
FIG. 14

METAL CASTING SYSTEM

BACKGROUND OF THE INVENTION

1. Field of the Invention

This invention pertains to a metal casting system and more particularly, to the casting of metals employing molds within particulate beds subjected to vacuum conditions.

2. Description of the Prior Art

There are several foundry operations which provide for the casting of molten metal within molds held in a particulate bed under reduced pressure conditions. In one of these procedures, a rigid pattern is formed of a thermally degradable material, such as a porous plastic foam (e.g., styrofoam) which is tightly surrounded by the particles of a particulate bed, such as sand. The molten metal is introduced into the pattern, and thermally destroys same while filling the resultant cavity formed by the pattern within the particulate bed. Vaporization of the pattern produces large amounts of gases which are removed by applying a reduced pressure or vacuum to the particulate bed. The pattern is destroyed concomitantly with the filling thereof by the molten metal, and a new pattern must be prepared for each casting that is desired to be produced.

In another foundry operation, a pattern is provided having the shape of the desired casting. This pattern is then coated with a matrix material which can be hardened to provide a shell mold. The shell mold is rigid and self-sufficient so as to be introduced directly into the particulate bed where casting operations are to be performed. If desired, the pattern about which the shell mold is formed may be thermally destroyed before the shell mold is introduced into the bed. For this purpose, the pattern containing the matrix coating can be heated externally of the particulate bed. As a result, the pattern is vaporized leaving a hardened shell surrounding a cavity having the configuration of the pattern. In this method of casting, the shell mold is introduced into a particulate bed, usually fluidized, so that the shell mold may be positioned without injury. Then, the particulate bed is placed into a non-fluidized condition and packed firmly about the shell mold. Lastly, the molten metal is introduced into the cavity formed by the shell mold and produces the desired casting. Simultaneously with the pouring of the molten metal, it is usually desired that the particulate bed be aspirated or operated under reduced pressure conditions relative to the shell mold so that any resultant vapors, gases, etc., are withdrawn through the bed rather than having to be expelled against the flow of molten metal from the shell mold.

In either of the above casting procedures of the prior art, there results a metal casting of the desired shape surrounded by a particulate bed which includes the residual materials of the original mold. Usually, fluidization of the particulate bed will destroy such small amounts of residual materials. In this manner, the casting can be readily removed in a relatively clean condition from the bed.

In the several prior art metal casting procedures, a pattern is required which is consumed during the casting procedure, either directly during the receipt of the molten metal into the mold, or during some earlier step in mold fabrication before the actual casting of the metal occurs. Thus, there is a large waste of the material from which the pattern is formed, as well as energy-wasteful procedures which are necessary for removing the vaporized thermally degraded material produced by the destruction of the pattern.

In the present invention, a porous pattern is provided in the desired shape of the casting. This pattern is surrounded with a thin thermal degrading film in a tight-fitting relationship. Then, a particulate bed is packed tightly about the film-surrounded pattern. A vacuum on the particulate bed holds the film tightly against the bed. Now, the pattern is removed from the surrounding film leaving as a mold, a film defined cavity having the desired shape of the casting in the bed. The cavity can be filled conventionally with molten metal to produce the casting. As a result, only a small amount of film material is consumed for each casting produced by this novel system. The porous pattern can be reused as desired. The present system provides special advantages in the casting of cylindrical and tubular members in repetitive numbers at great savings in material and energy consumed during the casting procedure.

SUMMARY OF THE INVENTION

The present invention is a metal casting system including both process and apparatus employing a pattern formed of a porous rigid material having the shape of the desired casting. A tight-fitting, thermal degrading film of relative thinness is formed about the pattern which has one of its ends exposed from the film. A particulate bed is tightly packed about the pattern and surrounding film, and the exposed end of the pattern is made accessible from the particulate bed. A reduced fluid pressure is established within the particulate bed relative to the pattern, and the film surrounding the pattern is tightly held against the particulate bed and slightly released from the pattern. The pattern is removed from the surrounding film and leaves therein a cavity bounded by the film with the shape of the desired casting in the particulate bed. The cavity defined by the film is filled with molten metal for forming the desired casting simultaneously with the thermal degredation of the film whose gaseous by-products are removed through the particulate bed.

In one embodiment the system is especially adapted for the casting of cylindrical and tubular shapes in the manufacture of castings.

In another embodiment, the present metal casting system provides a new mold wherein a minimum of materials is required to provide the necessary cavity for receipt of the molten metal within a particulate bed.

BRIEF DESCRIPTION OF THE DRAWINGS

In the Drawings:

FIG. 1 is a schematic illustrating an apparatus which can be employed for practicing the steps of the present invention.

FIG. 2 shows a placement of a thin film about a pattern having the desired shape of the casting for use in the apparatus of FIG. 1.

FIG. 3 shows the forming of a thin film about the pattern which is at reduced pressure conditions.

FIG. 4 shows the removal of the pattern from the thin film when placed within a tightly packed particulate bed subjected to reduced pressure conditions.

FIG. 5 shows a thermoplastic sleeve arranged to be readily introduced about the pattern shown in FIG. 2.

FIG. 6 shows the sleeve of FIG. 5 in telescoped relationship preparatory to being slidably placed upon the pattern of FIG. 2.

FIG. 7 shows another pattern for a tubular member which is surrounded by a tight-fitting thermoplastic film.

FIG. 8 shows the thin surrounding film of FIG. 7 within a particulate bed and supported by reduced pressure conditions with the subsequent introduction of an annular plastic ring and superimposed cylindrical sand core for the preparation of a cylindrical casting having a circumferential flange intermediate its ends.

FIG. 9 shows an external plastic ring placed about the lower end of a film surrounded pattern so that a cylindrical tubular member is cast having radially extending flanges at each of its ends.

FIG. 10 shows another pattern for a cylindrical tubular casting wherein an insulator is provided about the upper extremity of the film surrounded pattern as a heat insulator to insure proper casting of metal through an longitudinally extensive mold.

FIG. 11 shows another film surrounded pattern for a tubular casting which has an integral metal liner.

FIG. 12 shows the metal casting, in longitudinal section, produced from the film surrounded pattern of FIG. 11.

FIG. 13 shows a modified apparatus for producing the casting illustrated in FIG. 12 but using a variation of the film surrounded pattern of FIG. 11.

FIG. 14 shows yet another film surrounded pattern for producing the tubular metal casting illustrated in FIG. 12.

DESCRIPTION OF THE PREFERRED EMBODIMENTS

In the present metal casting system, the manufacture of cylindrical tubular metal castings is described wherein the novel process and apparatus are of special utility. However, it is to be understood that other shapes of castings may employ the new features of the present invention. For this purpose, a pattern is employed which is arranged so as to be reusable, if desired. The pattern is rigid and porous so as to be permeable to the flow of gas. The pattern is surrounded by a thin thermal degrading film which is formed into a tight-fitting relationship. The pattern surrounded by the film is placed within a particulate bed which is subjected to a reduced pressure so that the film is held securely against the bed and slightly released from the pattern. The pattern is removed from the particulate bed leaving a cavity which has the desired shape of the casting surrounded by a tightly packed particulate bed. The cavity is defined by the relatively thin film. Molten metal is introduced into the cavity and fills same while thermally destroying the thin film. The vapors produced by the casting of the molten metal are aspirated through the particulate bed so as not to interfere with the flow of molten metal filling the casting. It will be apparent that the pattern can have many shapes as long as it is adapted to be removed from the surrounding film when the film is held by reduced pressure within a tightly packed particulate bed.

FIG. 1 shows an arrangement of apparatus in accordance with the present invention for the production of tubular liners or castings. The apparatus is shown at the initial pouring of molten metal which has only partially filled the cavity defined by the thin film within the particulate bed. More particularly, a container or flask 11 is shown which has imperforate side walls 12 and an open top wall 13 with a gas-permeable bottom 14. The bottom 14 of porous ceramic, wire or other material, rests upon a plenum 16 that connects to a fluid system 17 for applying a pressurized gas to, or aspirating gas from a particulate bed contained within the flask 11. For this purpose, a manifold 18 is provided which is connected to a multiple port valve 19 and which valve connects selectively to a source of fluidizing gas 21, a reduced pressure or vacuum accumulator 22 and a vacuum pump 23. Also, a vacuum inlet 24 connects to the valve 19.

The fluidizing gas supply 21 is arranged so as to provide a flow of pressurized gas through plenum 16 and porous bottom 14 upwardly through a particulate bed 26 which is supported within flask 11. The bed 26 preferrably is fluidized for ready introduction of the mold members to be employed in the present invention into the particulate bed. Usually, the fluidizing gas supply 21 need only provide a suitable flow of pressurized fluid, such as air, which is passed upwardly through the material of bed 26 at a velocity of 50 ft./min. for large particle sizes, and only at about 5 ft/min. for small particle sizes of the bed material. Stated in another manner, the flow of fluid in the bed provides a pressure drop of approximately 1 psi for each foot of depth of bed 26. The bed will usually be selected from particles within sizes between 30–300 mesh.

Adjustment of valve 19 to connect accumulator 22 to manifold 18 will result in a vacuum being applied to flask 11. Usually the amount of fluid withdrawn from bed 26 need not be in large volume or for an extended period of time. For example, a withdrawal of gas in the amount of 2000–3000 cfm for a few seconds is usually sufficient. Usually, accumulator 22 need only have a sufficient volume at a reduced pressure to provide this result. The withdrawal of the gas from bed 26 in this manner provides for two results. One result is in holding securely the film which surrounds the pattern tightly against the bed 26. The other result is the removal of the small amount of gaseous products generated by the molten metal being received within the mold formed by thin film within particulate bed 26. In addition, valve 19 may be adjusted so as to interconnect either the fluidized gas supply 21 or the vacuum source accumulator 22 to inlet 24 for application of gas flows exterior of flask 11.

Vacuum pump 23 may be of conventional design, and it has been found suitable to employ one having the ability to provide a reduced pressure of 15 to 25 inches of Mercury at a flow volume in excess of 250 cfm.

Flask 11 is arranged for the casting of cylindrical tubular members, such as liner sleeves and the like. For this purpose, the flask is provided with an annular zone 27 which contains the particulate bed. The annular zone 27 is defined by upright cylindrical walls 28 and 29 supported at their bottom by an annular floor 31. Inner cylindrical wall 28 is sealed at its upper surface by a circular top wall 32. The upper perimeter of exterior cylindrical side wall 29 is sealed to side wall 12 of flask 11 by an annular top member 33. Cylindrical side walls 28 and 29 are permeable to gas flow but have such small openings that particulate bed 26 cannot be lost through them. For example, side walls 28 and 29 may be formed of a very tightly woven screen or other permeable membrane so that the bed on one hand can be fluidized, and on the other hand, can be subjected to reduced pressure by the proper setting of manifold valve 19. Alternatively, cylindrical side walls 28 and 29 may be provided by the same material as the porous floor 14 of flask 11.

Particulate bed 26 substantially fills annular zone 27 within flask 11. Particulate bed 26 may be of any suitable molding sand and the Zircon brand was used with good results. Other molding sands can be used and good results are obtained with grain sizes on the order of 50 to 150 mesk. For purposes of the present invention, particulate bed 26 will be fluidized to receive the mold members. Under non-fluidized conditions, the particulate is firmly packed in tight relationship about these molds. Any suitable mechanism for this purpose may be employed such as the electrically driven vibrator 34 which is mounted upon side wall 12 of flask 11. The vibrator need only provide sufficient mechanical energy to flask 11 such that particles of bed 26 are packed tightly about the molds contained in the zone 27.

The molds in which casting is undertaken in the present metal casting system are formed in a unique arrangement whereby the pattern having the shape of the casting may be reused repeatedly while the actual mold defining the cavity for the casting is supplied by a very thin and inexpensive expendable film. Referring to FIG. 2, the initial step of providing a mold for use in flask 11 is shown. For this purpose, a pattern is provided which is formed of a porous material such as open pore plastic foam or wood, having a plurality of transversing holes, that is permeable to gas flow. The pattern has the desired shape of the casting, and in the present embodiment, it is shown as a tubular cylindrical sleeve having a uniform tubular body 37 with an annular flange 38 formed at one end. The pattern 36 preferably also includes the usual gates, risers or runners 39 which insure that the molten metal will properly fill the mold. In the pattern as shown in FIG. 2, runner 39 is an annular member having a trapezoidal cross section. The base of runner 39 rests atop flange 38 on body 37. Now, pattern 36 is surrounded by a very thin film 41.

The film 41 is of relative thinness so as to be non-self supporting and of a material to be thermally degraded, such as by vaporization or carbonization. Examples of film materials are plastics, waxed paper, unpermeable organic fiber cloth and other substances subject to thermal degredation.

The film preferably is in the form of a thermoplastic sleeve which can be slidably placed about the exterior and interior surfaces of pattern 36.

Referring momentarily to FIG. 5, one type of plastic film is shown which is formed in a sleeve approximately twice the longitudinal dimension of pattern 36. Sleeve 42 has one portion 43 of a diameter adequate to slide over the exterior surface of pattern 36 and a second portion 44 of a reduced diameter which can be returned into portion 43, but has a lesser diameter so as to pass internally of pattern 36. This folded arrangement of sleeve 36 can be best seen in FIG. 6. With sleeve 42 arranged as shown in FIG. 6, it is passed about the cylindrical surfaces of both open ends 45 and 46 forming an annulus 40 at the exposed end of the pattern 36. After mounting sleeve 42 about pattern 36, the end 46 at the upper portion of the inner cylindrical part 46 is sealed or closed.

With sleeve 42 mounted upon pattern 36, it is subjected to an environment whereby the sleeve is formed into a tight film surrounding the patterns. As is shown in FIG. 3, an annular vacuum head 47 is placed on top of riser 39 and film 41 is secured to its edges in fluid tight engagement. Then, head 47 is connected through a hose 48 to a suitable vacuum source, such as inlet 24 of manifold 18. At the time that vacuum is applied through head 47 to porous pattern 36, film 41 is heated by a suitable mechanism until it is softened. Usually, the plastic sleeve 42 forming film 41 only needs to be heated to a temperature on the order of 250° F. for softening the film. As a result of the heat softening of film 41 and the application of the vacuum to pattern 36, film 41 is thermally formed (heat-shrunk) in tight-fitting relationship about pattern 36. The heating of film 41 can be provided by resistance wire heaters 49 which are connected through a connector 51 to a suitable source of electric power. Other means of heating of the film may be used, if desired. After film 41 has been thermally formed into a tight-fitting relationship about pattern 36, the heating is discontinued but preferably the application of the vacuum is continued until the film is cold.

At this time, pattern 36 surrounded by the tight-fitting film 41 are positioned in flask 11. Flask 11 is subjected to a flow of fluidizing gas from supply 21 through valve 19 and upwardly through bed 26. As a result, the bed material is fluidized and the film enclosed pattern is readily inserted into annular space 27 and surrounded by particulate bed 26. Now, valve 19 is adjusted so that the fluidizing flow of gas from supply 21 is terminated.

At this time, the protruding ends 45 and 46 of sleeve 42 are sealed to top wall 13 and circular top wall 32 by means, such as with an adhesive. With this arrangement, a substantial pressure differential can be established between particulate bed 26 and the atmosphere surrounding flask 11.

The valve 19 is operated to connect manifold 18 to accumulator 22 and a reduced pressure condition is established between particulate bed 26 and film 41 surrounded pattern. The application of vacuum directly to pattern 36 is continued while vibrator 34 is operated so that particulate bed 26 is very tightly packed about the exterior surfaces of film 41 surrounding pattern 36. At this time, the vacuum head 47 is removed from pattern 36 and it is exposed to atomspheric pressure. As a result of the greater pressure within pattern 36, the surrounding film 41 will be tightly held against the surrounding surfaces of particulate bed 26.

Riser 39 and pattern 36 are now withdrawn upwardly from flask 11 by sliding them from surrounding film 41 which is held tightly against particulate bed 26 by the reduced pressure condition within flask 11. This arrangement of withdrawal of the pattern and riser is shown more particularly in FIG. 4. It is to be noted that what remains now is a cavity 51 that is defined by film 41 in tight engagement with surrounding particulate bed 26. As long as flask 11 is under reduced pressure, film 41 maintains the desired configuration established by pattern 26. Usually, the reduced pressure within flask 11 should remain at not less than 10 and usually between 15 and 25 inches of Mercury during the metal casting step which follows.

Returning to FIG. 1, molten metal 52 is supplied by a ladle 53 suspended through some suitable anchor 54 in an operative position above cavity 51. Molten metal 52 is then poured as quickly as possible into cavity 51. As the metal enters into cavity 51, it flows by gravity to its lowermost portions and simultaneously fills the cavity while thermally destroying film 41 which defines the boundary between the cavity and particulate bed 26. The small amounts of gaseous products of the thermal destruction of film 41 are aspirated through particulate bed 26 and removed through accumulator 22 and vacuum pump 23 for discharge to a suitable system. Stated in another manner, during the process of filling cavity 51 with molten metal 52, film 41 was thermally degraded by the metal then replaced immediately the film in its function of maintaining pressure against particulate bed 26 so that the desired shape of cavity 51 was not altered. Thus, a readily thermal-degradable, very thin film can be used in combination with the pouring of the molten metal in particulate bed 26 without requiring the sophisticated and non-reusable patterns and molds previously employed for producing metal castings. Because of the small residual materials from the thin film 41, the casting and particulate bed 26 are clean.

For example, film lined cavity 51 was formed as a cylindrical tubular member or liner sleeve within particulate bed 26 in accordance with the present procedure. Molten steel was poured into cavity 51 as quickly as possible with the total amount of about 200 pounds of molten metal being poured in five or six seconds to fill cavity 51. The reduced pressure condition within particulate bed 26 was maintained until the desired casting cooled and solidified. Then, the vacuum was released on particulate bed 26 and the casting was lifted free. The particulate bed 26 was fluidized when the casting was removed. The casting was clean in appearance.

A variety of thermal degrading materials for the film 41 can be employed to good use in the present system. For example, a film consisting of 4 mil thick polyethylene has been used to good advantage. It is to be noted, that cavity 51 provided from pattern 36 surrounded by film 41 is highly accurate in contour and configuration even though the film is not self-supporting. It was noted during an actual test of the present invention that the resultant casting proved to be an exact replica of the film-covered pattern and included wrinkles which were in the film due to a lack of perfection in the thermal forming of the film about the pattern. Thus, it will be appreciated that the metal casting system of this invention can produce within a particulate bed a cavity which is an identical duplicate of any desired pattern configuration. Various shapes of the desired casting may be readily provided and the only consumable item is a small amount of a relatively thin film.

The plastic film 41 can be selected from the group of thermoplastics consisting of polyethylene, acrylonitrile butadiene styrene (ABS), polyvinylchloride (PVC), cellulose acetate butyrate (CAB), vinylidene chloride (Saran), fluorocarbons (Teflon, Kel-F), chlorinated polyether (Penton), polycarbonates, polypropylene, nylons, and acetals (Delvin).

The film 41 can have any thickness as long as it withstands the reduced pressure exerted in flask 11, and is not too thick to be thermally formed into a tight surrounding relationship to pattern 36.

It is also apparent that films other than thermoplastic type could be used. In one test, a film was fabricated to fit closely around pattern 36 so that there was no need to thermally form the film against the pattern. Thus, a film of relatively brittle nature could be used if carefully preformed prior to placing it over the pattern, providing only that the film is of a material which will melt, sublimate, or otherwise be thermally degraded, at some temperature below that of the molten metal 52.

It will be apparent from the preceding description that pattern 36 may be of any desired shape as long as it can be withdrawn from particulate bed 26 when surrounding film 41 is held tightly thereagainst by the establishment of reduced pressure within flask 11. Also, the pattern can be made of several parts which will permit their disassembly and withdrawal leaving cavity 51 formed by the thin film within particulate bed 26. The only criterion for this desired shape and configuration of pattern 36 is that it can be removed by its free end exposed to the atmosphere above flask 11. The example given for pattern 36 was of a cylindrical tubular liner which had a rim 38 at one of its ends. Such tubular liners can be cast in accordance with the present invention wherein the rim is at mid-length of tubular body 37. For this purpose, a minor manipulation of the pattern is required.

Referring now to FIG. 7, a styrofoam pattern 56 has the form of a tubular member with an upper portion 58 and a lower portion 57 of different diameters forming a step 59 at their junction. As described for pattern 36 and using common element numerals, film 41 is thermally formed in tight engagement with pattern 56 which also can carry riser 39 for use during the casting step. Patten 56 is placed into particulate bed 39 which is then tightly packed about it. Then, flask 11 is subjected to a reduced pressure within particulate bed 36. The surrounding film 41 is slightly moved away from pattern 56 (at atmospheric pressure) and into tight engagement with the surrounding surfaces of bed 26. At this time, pattern 56 is withdrawn from the cavity defined by film 41 within bed 26. If the cavity within bed 26 were filled with molten metal, the tubular member would have precisely the shape of pattern 56. However, as can be seen in FIG. 8, an annular ring 61, of a thermally degradable material such as styrofoam, is placed on top of step 59 of the cavity 63 within bed 26. Then, a cylindrical sand core 62 having sufficient binder so as to be self-supporting is slidably inserted and seated atop ring 61. Thus, cavity 63 shown in FIG. 8 has a cylindrical configuration with a mid-length ring 61 of plastic material and an upper sand sleeve 62 which is not thermally degraded. As a result, the filling of cavity 63 with molten metal results in the metal vaporizing ring 61 in filling same, but integral in the resultant casting with the cylindrical portion of cavity 63. Sand core 62 remains within cavity 63 and defines the upper reduced diameter portion of the tubular sleeve so that the resultant casting has a uniform cylindrical wall with an integral external flange or ring provided in the shape of ring 61. It will be seen that fluidizing the particulate bed allows ready removal of the resultant metal casting provided by the arrangement shown in FIGS. 7 and 8.

Another embodiment of the present invention is shown by the pattern illustrated in FIG. 9. The pattern of FIG. 9 may be basically that which is described relative to FIG. 2 and the common portions carry like reference numerals. Film 41 in a tight-fitting relationship surrounds pattern 36 and riser 39. After film 41 has cooled and while vacuum is applied to pattern 36, an annular plastic ring 66 is slidably positioned over the lower end of film-covered pattern 37. This ring 66 has a configuration of the desired lower flange and the tubular member of desired casting. Now, film covered pattern 36 carrying ring 66 is placed into permeable bed 26 of flask 11 when the bed is in fluidized condition. Bed 26 in static condition is tightly packed about the film-covered pattern and application of reduced pressure is provided within flask 11. At this time, the vacuum is released from pattern 36 by the removal of vacuum head 47. Now riser 39 and pattern 36 are removed. However, the highly packed particulate bed 26 retains styrofoam ring 66 in position at the bottom of the cavity defined by the film. Upon the cavity being filled with molten metal, ring 66 is vaporized with the film 41 and the molten metal assumes integrally the shape of the film-defined cavity of pattern 36 and ring 66.

Where the desired configuration of the tubular member to be cast according to the present invention is of extended length, there may be occurrences where molten metal will solidify prior to the entire cavity 51 being filled. If desired, an insulator may be applied to the pattern so as to insure the complete filling of the cavity with molten metal. Referring to FIG. 10, the pattern as described in FIG. 2 is shown and like parts carry like reference numerals. However, prior to the placement of film surrounded pattern 36 into particulate bed 26, a ceramic insulator sleeve 67 is placed about the upper portion thereof. This insulator sleeve may be of ceramic, or other material. The sleeve contains the heat of the molten metal against loss to bed 26 and insures that the entire cavity 51 is filled void-free.

Another embodiment of the invention is illustrated in FIGS. 11–14. In this embodiment, the film surrounded pattern is adapted to produce a tubular metal casting which carries integrally a metal liner. For example, there is shown in FIG. 12 a metal casting which has a tubular exterior metal sleeve 73 and an integral inner tubular metal liner 72. The sleeve 73 can be of the same shapes and constructions as the castings previously described, particularly the casting illustrated as being poured from molten metal into the cavity 51 of FIG. 1.

The casting 70 has a tubular metal liner 72 which may have a different composition and physical properties from the sleeve 73. In example, the casting 70 can be manufactured for use in a pump cylinder wherein a pump body would receive the sleeve 73 and a piston reciprocates within the liner 72. For this purpose, the liner 72 could be manufactured from a high chromium iron and the sleeve of steel. The liner 72 is usually manufactured with thin walls, e.g., a wall thickness of between one-eighth to three-quarters of an inch. The liner may have a diameter of several inches and a length of a foot or more. The liner 72 could be cast by the process priorly described relative to FIGS. 1–4.

The liner conventionally is installed in the sleeve either by shrink-fitting or welded into an integral structure. By the present invention, the sleeve 73 is cast about the liner 72 and forms simultaneously the monolithic assembly of these tubular parts.

The pattern 36 used in FIGS. 1–4 can be used but with a wall thickness increased by the outside dimension of the liner 72. When the pattern 36 is removed, the liner 72 is inserted into the cavity 51 and forms the interior boundry wall against which the molten metal is poured. As a result, the molten metal fills the cavity 51 to form the sleeve 73 which cools uniformly and by molecular adhesion, metal wetting, shrinkage or for other reasons, is integrally connected to the liner 72. The resulting casting 70 may be removed for subsequent treatment as needed to produce the final desired product.

If desired, the pattern may be altered to accommodate the liner 72 as is shown in FIG. 11. In this arrangement, the pattern 71 is telescoped about the liner 72, the riser 39 installed and surrounded by the film 41. Then, heat and the vacuum head 49 is applied to this assembly. Now, this film surrounded pattern can be placed into the bed 26. The head, riser and pattern are removed. The remainder of the casting process may be the same as previously described. In any event, the pouring of the molten metal into the cavity provided by the film 41 forms the integral metal casting 70 uniting the sleeve 73 and liner 72.

It may be desired not to use the casting apparatus shown in FIGS. 1 and 4 to produce the casting 70, especially on long dimensioned castings, or where the internal opening of the liner 72 is small, or for other reasons.

In this situation, the casting apparatus 11 may be modified as is shown in FIG. 13. The basic apparatus of FIGS. 1 and 4 is used and like reference numerals are used on like parts. However, the inner cylindrical wall 28 is ommitted and the floor 31A is made continuous across the lower or bottom of the outer cylindrical wall 29. The pattern 71, liner 72, riser 39 and vacuum head 47 are employed as shown in FIG. 11. However, the film 41 is not returned upwardly through the liner 71. Rather, the film 41 is thermally fitted about the pattern 71 and liner 72, they are positioned and packed into the bed 26 to the position shown in FIG. 13. Then, vacuum is applied to the container 12 and the film 41 slightly released from the pattern 71 which is removed upwardly from the flask 11. The film 41 defines the cavity 74 about the liner 72 but the liner defines the interior wall of this cavity. Molten metal poured into cavity 74 produces the desired casting 70.

Another arrangement to produce the casting 70 is illustrated in FIG. 14. The pattern 71 is mounted about the liner 72. A consolidated sand core or plug 76 fills the interior of the liner 72. Preferrably, the sand plug 76 has a flat end 77 conforming to the bottom of the pattern and liner. Also, the plug 76 may extend upwardly above the pattern and riser 39 to form an interior seal for the vacuum head 47. Now, the film is thermally fitted about the pattern, and extends upwardly from the bottom 77 and about the sand plug 76. The film surrounded pattern is placed into the casting apparatus of FIG. 13 and the bed 26 packed about it. Placing the flask 11 under vacuum allows the pattern 71 to be removed leaving the cavity 74. However, the interior of the liner 72 is closed by the sand plug 76. Molten metal is poured into the cavity 74 to form the casting 70. After the casting 70 is removed from the bed 26, the sand plug 76 is readily removed either manually or by mechanical means.

There are several advantages in using the sand plug 76. First, the molten metal filling the cavity 74 cannot displace or slip beneath the bottom of the liner 72. Second, the molten metal cannot accidently enter the interior of the liner 72. Third, there is no void within the liner 72 to effect uniform heating/cooling of the liner.

Although the pattern 71 is shown that has a top rim 38 on it like the pattern 36, other tubular shaped patterns can be used to produce a unitary casting of a metal sleeve about a metal liner. Also, this procedure to produce the casting 70 can be combined with the embodiments shown in FIGS. 8–10, if desired. As a result, the casting 70 may have a variety of tubular shapes.

It will be apparent that various arrangements of the film surrounded pattern may be used in the present metal casting system. The pattern may be cylindrical or tubular or have any desired shape as long as the pattern can be slidably removed by its exposed end from the surrounding film held in the particulate bed under reduced pressure conditions. Stated in a different manner, the pattern is arranged to have no reentrant portion that would prevent its sliding removal from the film-defined cavity within the particulate bed.

In this system, the pattern can be reused and only a very thin thermoplastic film is consumed. As a result, the production of gases, smoke, etc., is reduced to a minimum. Also, significant energy is conserved since the molten metal for practical purposes is cast directly into a cavity defined only by the particulate bed.

It will be understood that certain features and alterations of the present metal casting system may be employed without departing from the spirit of this invention. These changes are contemplated by and are within the scope of the appended claims. It is intended that the present description be taken as an illustration of the preferred embodiment of this system in both process and apparatus.

What is claimed is:

1. A process for the manufacture of a cylindrical metal casting using a pattern having the shape of the casting comprising:

(a) providing a pattern of a porous rigid material having the shape of the desired casting, (b) forming a tubular sleeve of tight-fitting, thermally degradable film of relative thinness so as to be non-self-supporting about and enclosing all the surfaces of the pattern except one end of the pattern being exposed by an opening in said surrounding film and subject to a source of subatmospheric pressure, (c) inserting the film surrounded pattern into a fluidized particulate bed and terminating fluidization of said particulate bed while yet subjecting said patterns to subatmospheric pressure with said film surrounded pattern standing upright therein, (d) tightly packing said particulate bed about the film-surrounded pattern which stands upright therein and only the exposed end of the film surrounded pattern being accessible in the top surface of said particulate bed, (e) providing a reduced fluid pressure within said particulate bed relative to the pattern and its exposed end now subject to the atmosphere whereby said surrounding film is tightly held against said particulate bed and slightly released from the pattern, (f) removing manually the pattern upwardly by its exposed end from the surrounding film and leaving therein a cavity with an open top bounded by the film with the shape of the desired casting, and (g) filling through the open top of the cavity defined by the film with molten metal for forming the casting simultaneously with thermal degration of the film.

2. The process of claim 1 wherein said pattern is adapted to be slidably removed by its exposed end from the surrounding film of the tubular sleeve subjected to the reduced pressure condition within the particulate bed.

3. The process of claim 2 wherein said pattern has a tubular shape of the desired casting.

4. The process of claim 1 wherein said film is a thermoplastic member with a thickness of about 4 mils.

5. The process of claim 1 wherein said pattern has an insulator member telescoped about the film surrounded pattern before being tightly packed within the particulate bed.

6. The process of claim 1 wherein said pattern has a cylindrical shape of the desired casting and an annular member of thermally degradable material is telescoped about the film surrounded pattern before being tightly packed within the particulate bed.

7. The process of claim 2 wherein said pattern is removed and a molded sand core is inserted into the cavity defined by the film within said particulate bed whereby the cavity is varied in shape for the desired casting by the inserted molded sand core.

8. The process of claim 7 wherein said film surrounded pattern has a right cylinder tubular shape an enlarged diameter upper portion whereby the cavity surrounded by film has a reduced diameter lower portion, and an annular member of thermally degradable material is placed in the enlarged diameter upper portion of the cavity and a tubular molded sand core is inserted into the cavity and extends longitudinally the remainder of the enlarged diameter portion therein whereby the desired casting has a tubular shape with an annular flange surrounding its exterior cylindrical surface intermediate the ends thereof.

9. The process of claim 1 wherein fluid is removed from said particulate bed during introduction of the molten metal whereby gases produced by thermal degradation of the film defining the cavity are removed through the particulate bed.

10. A process for the manufacture of a metal casting having a tubular shape comprising:

(a) providing a reusable pattern of a porous rigid material having the tubular shape of the desired casting, (b) providing a tubular sleeve of tight fitting, thermally degradable film about the exterior and interior surfaces of the pattern with one annular end thereof being exposed from said film, (c) tightly packing a particulate bed about the film surrounding pattern which stands upright therein with said exposed annular end being unconcealed by said particulate bed, (d) establishing a fluid pressure gradient between the particulate bed and said pattern whereby said film is held against said particulate bed, (e) removing the pattern upwardly from the surrounding film and leaving therein a cavity with an open top bounded exteriorly and interiorly in the film having the shape of the desired casting, and (f) filling through the annular end of the cavity within the film with molten metal for forming the casting.

11. The process of claim 10 wherein said film is selected from the group of thermoplastics consisting of polyethylene, acrylonitrile butadiene styrene (ABS), polyvinylchloride (PVC), cellulose acetate butyrate (CAB), vinylidene chloridé (Saran), fluorocarbons (Teflon, Kel-F), chlorinated polyether (Penton), polycarbonates, polypropylene, nylons, and acetals (Delvin).

12. The process of claim 10 wherein said film is polypropylene.

13. The process of claim 10 wherein said film has a thickness of about 4 mils.

14. The process of claim 10 wherein said pattern has a cylindrical configuration of substantially uniform diameter, and the pattern is removed by sliding axial movement from said surrounding film.

15. The process of claim 10 wherein the fluid pressure gradient between the pattern and particulate bed slightly releases the surrounding film thereby permitting the pattern to be removed more easily from the surrounding film.

16. The process of claim 10 wherein a thermally degradable plastic annular member is mounted about the film surrounded pattern before said pattern is tightly packed with the particulate bed to provide a flange portion on the casting.

17. The process of claim 10 wherein said pattern has a cylindrical tubular shape and the film is a tubular sleeve with a first diameter to be received about the pattern and a free end to be returned through the central opening of the pattern.

18. A process for the manufacture of a metal casting having a tubular shape comprising:

(a) providing a pattern of a porous rigid material having the tubular shape of the desired casting, (b) placing a tubular thermoplastic film about the exterior of the pattern and returning one end of the film through the central opening of the pattern whereby the free ends of the film extend beyond the pattern forming an exposed annular end therebetween, (c) heating the film sufficiently to soften same and applying a vacuum at said exposed annular end of the pattern and to the annulus between the free ends of the film whereby the film is form fitted about the exterior and interior surfaces of the pattern, (d) cooling the film surrounding the pattern to harden the film thereabout, (e) tightly packing a particulate bed about the film surrounding the pattern which stands upright therein, (f) sealing the free ends of the film to an enclosure containing the particulate bed with said exposed annular end and the annulus exposed to atmospheric pressure and applying a vacuum to the particulate bed whereby atmospheric pressure holds the film tightly against the surrounding particulate bed, (g) removing the pattern upwardly from the surrounding film and leaving therein a cavity with an open top bounded by the film having the shape of the desired casting, and (h) filling through the open top of the cavity within the film with molten metal for forming the casting.

19. The process of claim 18 wherein said film is polypropylene which is heat softened at about 250° F.

20. The process of claim 18 wherein a thermally degradable plastic annular member is mounted about the film surrounded pattern before said pattern is tightly packed within the particulate bed to provide a flange portion on the casting.

21. The process of claim 18 wherein said pattern has an enlarged riser at its end adjacent the free end of the film, and the riser has sufficient volume to provide excess molten metal to compensate for shrinkage in forming the casting.

22. The process of claim 18 wherein said pattern has no significant laterally protrusive parts capable of restraining withdrawal from the surrounding film while subjected to a vacuum condition in the particulate bed.

23. The process of claim 18 wherein a thermal insulating sleeve is placed about the upper part of the film surrounded pattern before being tightly packed within the particulate bed.

24. The process of claim 23 wherein a thermally degradable plastic annular member is mounted about the film surrounded pattern adjacent to the thermal insulating sleeve prior to said film surrounded pattern being tightly packed within the particulate bed to provide a flange portion on the casting.

25. A process for the manufacture of a metal casting having a tubular shape as a right circular cylinder with an axial opening comprising:

(a) providing a pattern having the tubular shape of the desired casting from a porous rigid material, (b) sliding a tubular sleeve of thermoplastic film about the exterior surface and along its interior surface through the axial opening of the pattern, said sleeve having free ends projecting beyond one annular end of the pattern forming an annulus, (c) placing an annular riser member coaxially on the pattern within the annulus formed by the free ends of said sleeves, (d) heating and vacuum forming the sleeve tightly about the pattern and the riser member, (e) tightly packing a particulate bed about the pattern and the riser member standing upright therein but with the riser member exposed in said particulate bed to receive a charge of molten metal, (f) establishing a pressure gradient across the pattern and the particulate bed whereby the sleeve is held tightly by fluid pressure against the surrounding particulate bed, (g) removing the pattern and riser member upwardly from the surrounding sleeve leaving a cavity with an open top bounded exteriorly and interiorly by film within the particulate bed and the cavity having the shape of the desired casting, (h) filling through the open top of the cavity in the particulate bed with molten metal for forming the casting.

26. The process of claim 25 wherein the free end of the sleeve are sealed to the top surface of an enclosure containing the particulate bed and a vacuum is applied to the particulate bed thereby employing atmospheric pressure in the annulus to hold tightly the sleeve against the surrounding the particulate bed.

27. The process of claim 25 wherein the pressure gradient across the pattern and particulate bed is sufficient to release the pattern for ready axial withdrawal from said sleeve.

28. The process of claim 25 wherein the sleeve is heated sufficiently to soften the thermoplastic film and a pressure gradient established between the sleeve and the exterior and interior surfaces of the pattern whereby the sleeve tightly form fits to the pattern while the film is cooled to harden it.

29. The process of claim 25 wherein said sleeve has a first diameter portion and a second diameter portion with a closed end, and said second diameter portion is folded internally of said first diameter portion whereby the exposed annular end of said pattern is received at said first diameter portion.

30. An apparatus for the manufacture of metal castings having a tubular shape comprising:

(a) a flask having an imperforate top wall with an opening provided therein, (b) coaxial inner and outer cylindrical sidewalls aligned vertically and extending downwardly from said opening in the top wall, said sidewalls being permeable to gases but not a particulate bed, (c) an annular floor joining together said cylindrical side walls, (d) a circular top member covering the inner cylindrical sidewall, (e) a particulate bed disposed within the annular space between the cylindrical sidewalls, (f) means to vibrate said particulate bed, (g) vacuum means connected to said flask to withdraw fluid from said particulate bed and leave same at a reduced pressure condition, and (h) said annular space receiving coaxially a film surrounded cavity having the tubular shape of the desired casting immersed within said particulate bed and said film held tightly against said particulate bed by the reduced pressure condition therein.

31. In the manufacture of a cylindrical metal casting having a tubular shape the improvement comprising:

(a) a pattern formed of a rigid porous material in the tubular shape of the desired casting, (b) a tubular sleeve of thermally degradable film covering in tight fitting relationship the exterior and interior cylindrical surfaces of the pattern, (c) said tubular sleeve having a free end projecting beyond the annular end of said pattern forming an annulus therebetween and leaving one end of said pattern exposed, and (d) said pattern having no significant laterally protrusive parts whereby said pattern by its exposed end is slidably removed from said sleeves leaving a film surrounded cavity with an open end of the tubular shape of the designed metal casting upon applying a reduced pressure about the sleeve.

32. A process for the manufacture of a metal casting having a tubular shape comprising:

(a) providing a pattern of a porous rigid material having a tubular shape with an axial central cylindrical opening;

(b) inserting a metal liner into said central opening and said pattern and liner having the shape of the desired casting;

(c) thermally forming a tubular sleeve of tight fitting thermally degradable thermoplastic film about the exterior surface of the pattern and liner with one end of said pattern being exposed from said film;

(d) tightly packing a particulate bed about the film surrounding pattern and liner standing upright except for said exposed end being unconcealed by particulate bed;

(e) establishing a fluid pressure gradient between the particulate bed and said pattern through its exposed end whereby said film is held against said particulate bed;

(f) removing the pattern upwardly by its exposed end from the surrounding film and leaving therein a cavity with an open top but bounded exteriorly in the film and interiorly by said liner; and (g) filling through the open top of the cavity within the film and about said liner with molten metal for forming the casting.

33. The process of claim 32 where a sand plug is inserted internally of said liner, and said sand plug extends substantially the length of said liner.

34. The process of claim 33, wherein said sand plug has a flat end aligned with one end of said pattern and said liner, and said film is placed about said pattern and extends upwardly from the flat end on said pattern and said liner and about said sand plug.

35. The process of claim 32, wherein said pattern and said liner have one end forming a flat surface, and said film is placed about said pattern and across the flat end on said pattern and said liner.

36. A process for the manufacture of a unitary metal casting having an internal tubular metal liner surrounded integrally by a metal sleeve comprising:

(a) providing a pattern of a porous rigid material having the exterior configuration of said sleeve and a central opening adapted to receive said metal liner;

(b) inserting said liner into said central opening of said pattern;

(c) forming a tubular sleeve of tight fitting thermally degradable film about the exterior surfaces of said pattern and said liner with one end of said pattern being exposed from said film;

(d) tightly packing a particulate bed about the film surrounded pattern and liner standing upright except for said exposed end being unconcealed by said particulate bed;

(e) removing the pattern upwardly by its exposed end from the surrounding film and leaving in said particulate bed subject to a reduced pressure a cavity with an open top but having the shape of said sleeve bounded exteriorly by said film and interiorly by said liner;

(f) filling through the open top of the cavity with molten metal for producing the unitary casting wherein the molten metal forms said sleeve in integral engagement with said liner; and (g) separating said casting from the particulate bed.

37. The process of claim 36, wherein a sand plug is inserted internally of said liner, and said sand plug extends substantially the length of said liner.

38. The process of claim 37, wherein said sand plug has a flat end aligned with one end of said pattern and said liner, and said film is placed about said pattern and extends upwardly from the flat end on said pattern and said liner and about said sand plug.

39. The process of claim 36, wherein said pattern and said liner have one end forming a flat surface, and said film is placed about said pattern and across the flat end on said pattern and said liner.

40. The process of claim 36, wherein said liner is formed of high chrominum iron and said sleeve is formed from steel or a ferrous metal containing substantially less chrominum.

* * * * *